United States Patent [19]

Jackson

[11] Patent Number: 4,551,285

[45] Date of Patent: Nov. 5, 1985

[54] FLOTATION MACHINE AND AERATION IMPELLER

[75] Inventor: Michael A. Jackson, Sacramento, Calif.

[73] Assignee: Envirotech Corporation, Menlo Park, Calif.

[21] Appl. No.: 578,343

[22] Filed: Feb. 9, 1984

[51] Int. Cl.[4] ..... B01F 3/04

[52] U.S. Cl. ..... 261/87; 209/169; 416/182; 415/213 R

[58] Field of Search ..... 261/87; 416/182; 415/213 R, 213 B; 209/169

[56] References Cited

U.S. PATENT DOCUMENTS

| | | | |
|---|---|---|---|
| Re. 27,380 | 5/1972 | Anderson | 261/87 |
| 2,711,823 | 6/1955 | Kihlstedt et al. | 209/169 |
| 2,713,477 | 7/1955 | Daman | 261/87 |
| 2,973,095 | 2/1961 | Anderson et al. | 261/87 |
| 3,382,980 | 5/1968 | Silva | 261/87 |
| 3,393,802 | 7/1968 | Logne et al. | 209/169 |
| 3,437,203 | 4/1969 | Nakamura | 209/169 |
| 3,491,880 | 1/1970 | Reck | 261/87 |
| 3,820,759 | 6/1974 | Hege | 261/87 |

FOREIGN PATENT DOCUMENTS

| | | | |
|---|---|---|---|
| 366890 | 1/1973 | U.S.S.R. | 209/169 |

*Primary Examiner*—Tim Miles

*Attorney, Agent, or Firm*—Carl A. Rowold

[57] ABSTRACT

A froth flotation machine (40) having a rotary air-supply shaft (42) vertically disposed in a vessel (41) includes an impeller (50) comprising a series of interconnected blades (52,53). Extending radially and fixedly depending from a flat impeller plate (52) is a pumping blade extending over one-half the distance from the plate outer periphery to the shaft. Blade (53) is an air-inducing vane of lesser radial length which aids in inducing air from shaft (42) to pumping blades (52). The vane has a height less than 50% of the height of the pumping blade. The pumping blade has an L/H ratio of from 0.8 to 1.4 where L is its radial length and H is its vertical height. Slurry is pumped by the blades (52) from bottom of the vessel through a central aperture in a surrounding fixed stator base (56) having stator bars (55) extending upwardly and forming parallel-sided passageways (63,64) for pumped fluid.

23 Claims, 8 Drawing Figures

FLOTATION MACHINE AND AERATION IMPELLER

BACKGROUND OF INVENTION

1. Field of the Invention

This invention relates to flotation apparatus for processing mineral pulps or other types of slurries. Flotation chemicals and air are mixed with the pulp, slurry or other liquid-solids mixture to selective separate a solid material, or particular ones of several solid materials, from the pulp by a flotation process. Flotation processes involve the selective adherence of solids particles on gas or air bubbles which particles are lifted by the raising bubbles for removal from adjacent the top or other outlet within the flotation machine tank.

2. Description of the Prior Art

Most flotation machines have a single or multiple unit construction wherein a rotor having relatively short blades is rotated within a tank to pump and circulate pulp within the tank and include an air supply means in the form of a hollow tube associated with the impeller and a surrounding fixed stator. Typically of these are those shown in U.S. Pat. No. 2,243,309 where an apertured flat plate having radial upstanding blades is provided; U.S. Pat. No. 1,881,412 where 90° depending rectangular radial blades are shown; and U.S. Pat. Nos. 3,843,101; 3,882,016; and 4,062,526 where blades of various lengths are on both sides of an impeller plate, extend radially over only the outer periphery of a flat plate and are spaced 22.5° apart. A portion of the lower blade in the '016 patent extends below the stator bottom. U.S. Pat. No. 2,875,897 shows bar type impeller legs and a stator (FIG. 6) having parallel-sided passages; U.S. Pat. No. 4,265,739 has upstanding radial blades on an outer plate periphery; U.S. Pat. No. 3,491,880 shows a one piece radial star-like rotor and a one-piece stator; and U.S. Pat. No. 3,647,066 shows depending blades on a flat plate outer periphery with a surrounding stator. This latter patent discloses structures which are similar to the prior art marked as such in the attached drawings and represent commercial flotation machines now being manufactured and sold by applicant's assignee under the trademark "Agitair".

SUMMARY

In recent years, economic considerations have put emphasis on the power requirements of flotation processes and equipment, as well as in other processes, and has led to utilization of techniques to reduce the energy consumption.

One of these techniques involves lowering of the mechanism speed which in turn lowers the circulation rate. This technique has the negative effect of reducing the specie/bubble contact probability primarily by reducing the pulp circulation and secondarily by reducing the maximum air dispersion limit capacity.

This invention, by increasing the radial length of the rotor blades (extending radially toward the rotor root from the impeller plate outer periphery), by the addition of inboard air inducing vanes and by a change in the stabilizer flow channel from a radially increasing area to a fixed area channel, provides a more efficient mechanism. This mechanism produces a higher circulation rate with a reduction in mechanism horsepower while maintaining or increasing the maximum air dispersion limit.

It has been found that these radially longer pumping blades which extend from the air inducing vanes next to the central air supply aperture in the impeller plate should have an L/H ratio $\simeq 1$ where L is the radial blade length and H the blade vertical height. More particular the L/H ratio is preferred to be from 0.8 to 1.4. Such L/H ratio produce a higher rate of pulp circulation with fewer blades than prior art machines of similar size and use less power by reason of an increased radial length for imparting energy to the pulp. Relatively smaller in length and height and normally thinner inner vanes act as air inducing vanes which aid in moving air from the central air port to the outer pumping portions of each blade for optimum bubble production and increased aeration of the pulp. A fixed area parallel-sided passageway in the surrounding upstanding stator reduces fluid eddies within the passageway. Having the horizontal bottom of the relatively large outer pumping blades extending below the stator plate additionally enhances the circulation pattern in the tank.

BRIEF DESCRIPTION OF THE DRAWINGS

FIGS. 1, 1*a*, 2 and 2*a* show prior art impeller mechanisms which have been used commercially in the United States and abroad for various metallurgical processing applications. Impellers of this type have been utilized in flotation machines as shown in U.S. Pat. No. 3,647,066 and sold by The Gallagher Company, Salt Lake City and by WEMCO, Sacramento, Calif. under the trademark "Agitair". The prior art impeller shown in FIGS. 1 and 1A employs an annular impeller plate 10 which is connected to a central impeller shaft 11 by a suitable spider or other means. Extending from the top surface of the plate 10 is a first series of impeller blades 12 at spaced intervals around the circumference of plate 10 (only two are shown) and which extend from the outer periphery of the impeller plate to a position generally less than half of the radial distance to the shaft 11. These rotors blades 12 have a radial inner portion of less width than the radial outer portion at the periphery. Depending from the plate 10 are additional short blades 13 also at spaced intervals around the circumference of plate 10 (only two are shown) and which extend a partial distance from the outer periphery of plate 10 to a position on the radius approximately half the length of the upper blades 12.

Figure 1:
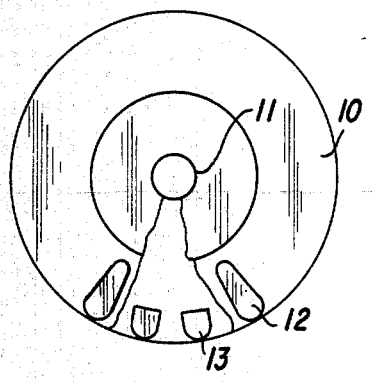
FIG. 1 PRIOR ART
FIG. 1 is a schematic cutaway top view of a prior art flotation impeller.
Figure 2:
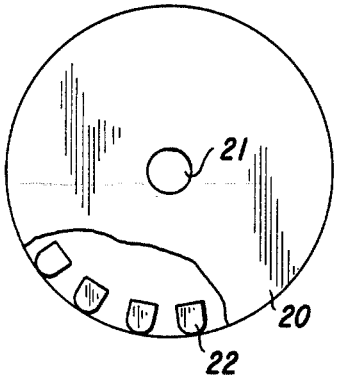
FIG. 2 PRIOR ART
FIG. 2 is a schematic cutaway top view of a second prior art flotation impeller.
Figure 2A:
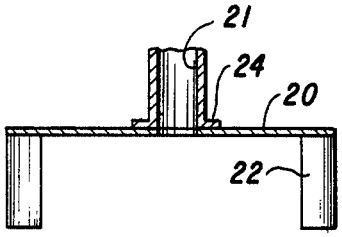
FIG. 2*a* is a partial schematic side view of the impeller of FIG. 2.

The FIGS. 2, 2A device is similar to the FIG. 1 prior art except that it only has a series of short blades 22 depending from the periphery of an inperforate plate 20 which is attached by a flange 24 to an air-supply shaft 21, which provides a source of air for the impeller and the turning torque for the rotary motion of the impeller.

Figure 3:
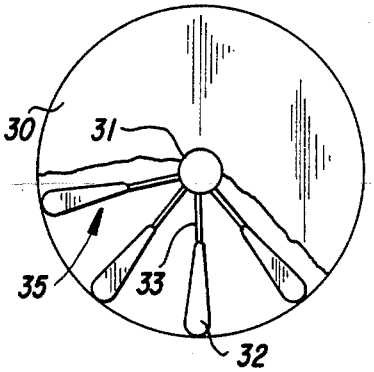
FIG. 3 is a schematic cutaway top view of the impeller of this invention.
Figure 1A:
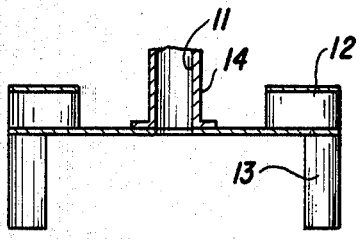
FIG. 1*a* is a partial schematic side view of the impeller of FIG. 1.
Figure 3A:
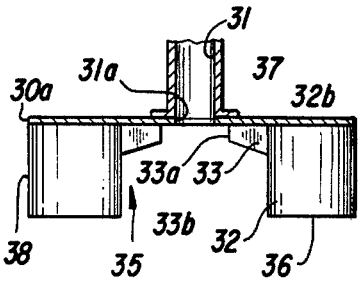
FIG. 3*a* is a partial schematic side view of the impeller of FIG. 3.

FIG. 3 shows the impeller of this invention as including a series of blades generally shown at 35, each comprising an inner air-inducing vane 33 and an outer pumping blade 32. Each of the blades 35 radiate from the central shaft 31 and are positioned and attached to depend from the under side of impeller plate 30. As can be seen more clearly in FIG. 3A, blades 35 particularly include a relatively short air-inducing vane 33 of relatively small height having its inner terminus 33*a* immediately adjacent the outlet 31*a* of hollow shaft 31 and including an outwardly and downwardly tapered bottom surface 33*b* extending to the second or pumping blade 32. Blade 32 extends from the interconnection at 32*b* with the air-inducing vane 33 to the outer periphery 30*a* of plate 30. Surface 37 of vane 33 represents the radial length of the air-inducing vane and surface 36 represents the radial length (L) of the second blade which together form the overall blade 35. Surface 38 represents the total height (H) of the second blade 36 extending from the underside of plate 30 to the bottom surface 36.

Differences of the FIG. 3 invention over the FIGS. 1 and 2 prior art include an imperforate impeller plate 30 having fixed depending blades 35 which are comprised of two portions—one an air-inducing vane extending from the air inlet or hollow shaft 31 to an intermediate position on the overall blade and a radially longer pumping blade extending from that intersection to the periphery of the impeller plate. It has been found that there is a optimum relationship between the radial length (L) and height (H) of the second or pumping blade 32, namely that this ratio should be equal to or approximately 1. The preferred range of the L/H ratio is from 0.8 to 1.4. The provision of the radially longer pumping blades with the aforesaid L/H ratio produces a higher rate of pulp circulation with fewer blades and less power by providing an increased radial length for imparting energy to the fluid. The air-inducing vanes 33 aid in moving air from the centrally located shaft port to the pumping blades 32. Vanes 33 have a radial length less than the length of pumping blades 32 and a height at interconnection 32*b* less than 50% of the height of blades 32. Since the vane is subject to a minimum of abrasion by the slurry it can be relatively thin whereas the pumping blade is bulbous in horizontal cross-section. Blade 32 and vane 33 may be integrally formed.

Figure 4:
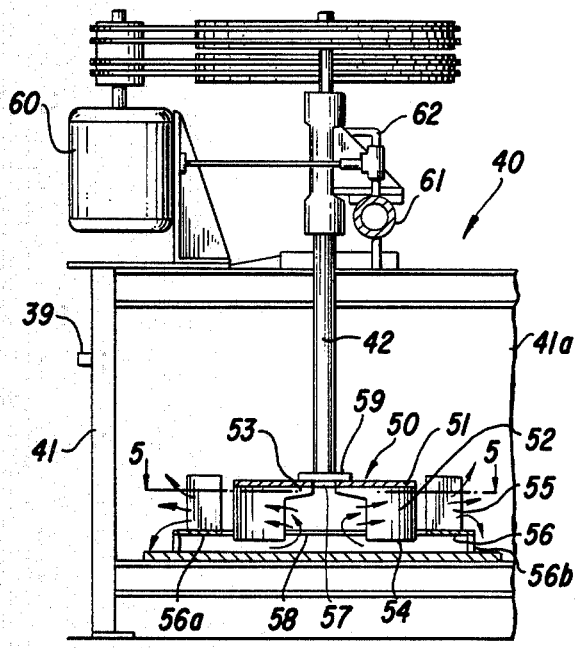
FIG. 4 is a partial cross-sectional side view of a flotation machine including the impeller of this invention.

The above construction is seen in the FIG. 4 flotation machine. Flotation machine 40 comprises a tank 41 whichmay be a single rotor tank or of large enough size to accept multiple motor-impeller-stator combinations within its confines. Additional cells may be connected to cut-off wall 41*a* to augment the overall volume of tank 41. Impeller 50 is inserted into the tank and attached by suitable shaft collar 59 to a hollow drive shaft 42 which extends above tank 41. An electric motor 60 drives rotary shaft 42 through a system of sheaves, pulleys and drive belts. A suitable air supply either from a blower, other source of compressed gas or atmosphere is normally provided through pipe 61 and a series of pipe connections 62 and shaft apertures (not shown) to the interior of shaft 42. Vanes 53 induce air from the bottom of shaft 42 into the pulp which is circulating from the bottom of tank 41 as shown by the central arrows. Pump blades 52 extend downwardly through an aperture 58 in a stator plate 56. Upstanding from plate 56 is a series of stator bars 55 shown more clearly in FIG. 5.

Pumping action of blades 52 pump the fluid slurry from the tank bottom, through the aperture in the stator plate 56, laterally through the pumping blades 52 and out through the passageways between stator bars 55. Bottom surface 54 of the pumping blades extends below the bottom surface of stator plate 56. Stator plate 56 is normally supported by pins 56*b* or an open truss structure on a wear plate 57 at the bottom of tank 41. As fluid slurry is pumped through the blades 52 the pulp passes through the passageways between the stator bars to the outer periphery of the tank as shown by the arrows and a portion circulates under the stator base 56 to be recirculated through the pump blades. Other portions of the circulating pulp circulate above the stator into the tank volume above the impeller where the desired products attach themselves to the air bubbles which rise over an upper tank edge or exit from a tank side outlet 39 into a froth discharge box (not shown) for further processing.

Figure 5:
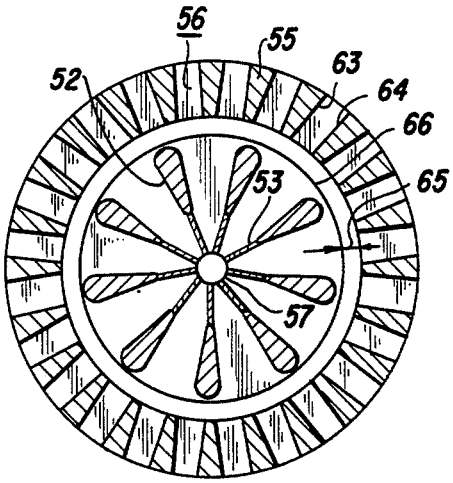
FIG. 5 is a top sectional view taken on the line 5—5 of FIG. 4.

FIG. 5 is a view taken downwardly on line 5—5 of FIG. 4. It shows each of the nine pumping blades 52 connected to the air-inducing vanes 53 forming the overall blade structure which rotates with respect to the stator. The stator comprising a series of 24 wedge-shaped bars 55 which are positioned around the stator so as to define passageways bounded by parallel sides 63, 64 of adjoining bars. The horizontal width of the parallel-sided stator passageways are preferred to be from about $2\frac{3}{8}''$ to $3\frac{5}{8}''$ and the vertical height of the passageway from about $8\frac{1}{4}''$ to 13″ depending on rotor size. For larger sizes of machines these dimensional ranges are to be scaled up in size. The bottom 54 of each pumping blade 52 extends below the bottom stator surface 56*a* of stator base 56. A gap 65 extends from the locus of peripheral tip ends of the pumping blades 52 represented by circle 66 to the inner periphery edges of the bars 55. This gap or spacing between the rotating pumping blades and the fixed stator is normally in the range of from 1″ to $1\frac{1}{2}''$ inches but is scaled dependent on the size of the machine.

Due to the improved air-inducing and pumping functions of the complete blades 52, 53 a lesser number of radial blades are needed than in the prior art. Thus blades which are radially spaced 36°–45° from each other (blade center line to centerline) along with stator bars radially spaced 12°–18° from each other (centerline to centerline) and where each parallel-sided stator passageway subtends an arc of 8° to 12° at its inner entrance are preferred embodiments of the invention. A construction in which nine blades and twenty-four bars are utilized is believed to be an optimum configuration. The impeller plate, blades, integral vanes and stators may be molded natural or synthetic rubber such as Neoprene, with or without an interior plate support.

Testing of the invention was conducted by comparison with the prior art devices shown in FIGS. 1 and 2 in 40, 100 and 500 cubic feet volume sizes. Five rotor sizes (21″, 24″, 27″, 30″ and 33″) and geometrically scaled stators were selected for testing based on long commercial experience with the prior art machines. Tests were run in a "water only" test condition where water is used as liquid and there are no solids-bearing pulp and in a "pulp" mode test condition where a significant quantity of solids existed in the fluid being pumped. "Water only" tests were performed measuring power, circulation, maximum air distribution capability and surface turbulence for a range of mechanism speeds. Once hydrodynamic parameters were analyzed, rotor size and mechanism speed were determined for "pulp"

tests to further evaluate suspension capability. As used in the test results set forth below "maximum air distribution capability" is the specific quantity of air which can be introduced into the machine without negative effects of geysering or excessive surface turbulence.

The test purpose was to evaluate the mechanism of FIGS. 3–5 in Agitair 48×40, 60×100 tanks and a WEMCO No. 144 tank which respectively represent 40 ft.$^3$, 100 ft.$^3$ and 500 ft.$^3$ machines. An appropriate rotor diameter was determined to be one which satisfied the power reduction, maximum air transfer and surface turbulent conditions as well as a mechanism speed suitable for commercial plant use. Each machine size was adapted to accept the rotor and stator of the present invention. The FIGS. 3–5 mechanism was positioned relative to the tank bottom the same distance as used in practice with the impeller shown in FIG. 2. Circulation was measured by stagnation tubes identical to those used in prior FIG. 1 and FIG. 2 tests. Power and air transfer rate were measured using the appropriate metering devices namely a kilowatt meter and a pitot tube. The surface turbulence was determined by visual means. Each rotor was operated at three speeds and at two air transfer rates per speed. One fixed air transfer rate was chosen for all rotors tested in a given vessel. The air transfer rate was chosen at the point of or just below incipient geysering.

Suspension tests were conducted utilizing 20% and 35% sand solids by weight at one mechanism speed and one air transfer rate. Samples were withdrawn from ports along the sidewall. These samples were then analyzed for solids content and sand size distribution to determine the total percentage of charge in suspension, the distribution of the suspended portion and the relative distribution of coarse and fine fraction in suspension.

In Table 1 each of the FIG. 3–5 machines in a particular test in comparison with the prior art were extrapolated to have the same horsepower as the prior art machines. It can be seen that an air circulation increase over the prior art of from 8 to 124 percent was obtained using the mechanism of FIGS. 3–5.

Table 2 represents a performance comparison at the manufacturer's recommended rotor speeds.

TABLE 2

| | PERFORMANCE COMPARISON AT THE RECOMMENDED SPEED | | | | | | |
|---|---|---|---|---|---|---|---|
| | FIGS. 3–5 MECH. | | | | | | |
| TANK SIZE | MECH. SPEED (RPM) | ROTOR DIA. (IN.) | POWER (HP) | CIRC. CFM | MAX. AIR ACFM | % CIRC. INC. | % POWER DEC. |
| 48 × 40 | 143 | 21 | 2.4 | 640 | 35 | Negl. | 18 |
| 60 × 100 | 143 | 24 | 4.5 | 740 | 115 | 95 | 30 |
| 102 × 500 | 116 | 30 | 9.6 | 1950 | 160 | Negl. | 9/21* |

*using FIG. 1 impeller

It can be seen from comparing the mechanism of FIGS. 3–5 with the FIGS. 1 and 2 prior art devices that a power decrease of 9 to 30 percent was obtained in the various vessel size tests. For example, in the 500 cubic foot size, only 9.6 horsepower was necessary in the FIGS. 3–5 machine while the power draw in the FIG. 2 machine and in the FIG. 1 machine were 10.5 and 12.1 horsepower, respectively. A large increase in air circulation was evident in the size tank. Maximum air distribution capability was not negatively affected by the FIGS. 3–5 design with improvement noted in the 40 ft.$^3$ machine.

Thus it can be seen that the mechanism of FIGS. 3–5 significantly reduces the mechanism power while maintaining or increasing the circulation rate. In addition the mechanism does not affect the maximum air transfer rate or surface turbulence. Rotor sizes of 21, 24 and 30 inch diameters are preferred for the 40, 100 and 500 cubic foot machines, respectively. The greatest reduction power occured in the 60×100 machine size where "water only" tests using the 24 inch rotor show a 28% reduction in power and a 95% increase in circulation at 135 rpm rotor speed. Some of this comparative increase in circulation is due to the ability of the present invention to dispersed air at the rate of 90 acfm. Comparison of the mechanisms at lower air transfer rates show much the same relationship; for although the circulation of the FIG. 2 prior art machine increases with decreased air transfer, the power also increases at roughly the same rate. The FIGS. 3–5 mechanism significantly improved the surface turbulence of the 40 cubic foot machine over that shown in FIG. 2. In the other tested sizes there was no negative effect by use of the FIGS. 3–5 mechanism.

Each of the tested mechanisms employing the design of FIGS. 3–5 were stopped in their respective vessels for 1 to 3 days and then restarted. Sand volume at 35% solids is sufficient to fully cover the rotor and stator. Air was first delivered and after a period of approximately 30 seconds the rotor was started. It started successfully without further attention. Start up without first using

TABLE 1

| TANK SIZE | ROTOR | | | PERFORMANCE COMPARISON | | MAX. | FIGS. 3–5 MECH. | | | | | % |
|---|---|---|---|---|---|---|---|---|---|---|---|---|
| Weir length × Vol. | TYPE | SPEED (RPM) | DIA. (IN.) | POWER (HP) | CIRC (CFM) | AIR (ACFM) | SPEED (RPM) | DIA. (IN.) | POWER (HP) | CIRC (CFM) | AIR (ACFM) | CIRC INC |
| 48 × 40 | FIG. 2 | 150 | 27 | 3.0 | 640 | 20 | 145 | 21 | 3.0 | 680 | 35 | 22 |
| 60 × 100 | FIG. 2 | 160 | 27 | 6.4 | 380 | 60 | 170 | 24 | 6.4 | 840 | 114 | 121 |
| | | | | | | | 137 | 27 | 6.4 | 860 | 122 | 124 |
| 102 × 500 | FIG. 2 | 130 | 33 | 10.5 | 1900 | 140 | 120 | 30 | 10.5 | 2050 | 120 | 8 |
| | | | | | | | 116 | 33 | 10.5 | 2100 | 190 | 11 |
| | FIG. 1 | 130 | 33 | 12.1 | 1800 | 230 | 127 | 30 | 12.1 | 2200 | 225 | 22 |
| | | | | | | | 122 | 33 | 12.1 | 2200 | 130 | 22 |

air presented problems in the prior art devices of FIGS. 1 and 2 in the 48×40 and 60×100 machines. The 500 cubic foot machine employing the prior art devices of FIGS. 1 and 2 started without air addition. All of the suspension results showed that there was no substantial difference in the suspension capability of the FIGS. 3–5 device when compared to the prior art FIGS. 1 and 2 devices.

Table 3 shows a chart showing the relationship of the various rotor sizes to stator sizes and examples of various dimensions of the stator bars and pumping blades. The distance between the bottom of the pumping blades and the cell floor are also given along with the ratio L/H of pumping blades.

TABLE 3

| ROTOR | STATOR | | | | | | | | | |
|---|---|---|---|---|---|---|---|---|---|---|
| Diameter | O.D. | I.D. | A | B | C | D | E | F | G | L/H = F/E |
| 33 | 50½ | 36 | 3.0 | 6 15/16 | 1.0 | 13.0 | 9.0 | 8.0 | 8.5 | 0.89 |
| 30 | 45⅞ | 32¾ | 2⅝ | 6¼ | 15/16 | 11⅞ | 8 3/16 | 7¼ | 8.5 | 0.87 |
| 27 | 41⅜ | 29½ | 2⅜ | 5⅝ | 13/16 | 10⅝ | 7⅜ | 6½ | 7.0 | 0.85 |
| 24 | 36¾ | 26⅛ | 2⅛ | 5.0 | ¾ | 9½ | 6½ | 5 13/16 | 6.0 | 0.89 |
| 21 | 32¼ | 22 15/16 | 1⅞ | 4¼ | ⅝ | 8¼ | 5¾ | 5.0 | 6.0 | 0.87 |

In the above table, A represents the outside width of the stator bar, B the radial length of the stator bar and C the inside width of the stator bar facing the rotor. D represents the height of the stator bar, E is the height of the pumping blade, F the radial length of the pumping blade, G the gap between the bottom edge of the pumping blade and the bottom surface of the tank and L/H is the ratio of column F divided by column E.

The above description of this invention is intended to be illustrative and not limiting. Other embodiments of this invention will be obvious to those skilled in the art in view of the above disclosure.

What is claimed is:

1. A froth flotation machine comprising:

a tank including vertical side walls to maintain a level of flotation pulp therein;

a motor-driven rotatable shaft extending into said tank;

an impeller attached to a bottom portion of said shaft; and means for delivering air to said impeller adjacent a central portion of said impeller;

said impeller comprising a flat plate extending radially from said central portion, and a series of radially extending, vertically depending blades affixed to said plate, said blades including a first radially-inward vane extending from said central portion for inducing air from said air-delivery means to an interblade region and a second radially-outward blade extending from a position adjacent the outer periphery of said air-inducing vane to a position adjacent to the outer periphery of said flat plate for pumping and distribution of aerated pulp to a position radially exterior of said blades toward said tank side walls, said first vane being a vertically mounted flat plate and having a bottom edge portion tapered downwardly from said impeller central position to an intersection attachment with said second blade, and first vane further having a radial length less than the radial length of said second blade and a depending maximum height less than 50% of the height of said second blade.

2. The invention as set forth in claim 1 in which said impeller flat plate is an imperforate annular plate and is attached to an open end of a rotatable hollow air shaft extending from above said pulp level.

3. The invention set forth in claim 1 wherein said second blade is rectangular in vertical radial section and has an L/H ratio of from 0.8 to 1.4 where L is the horizontal radial length of the second blade and H is the vertical height of the second blade.

4. The invention set forth in claim 1 in which said shaft is hollow and has a bottom open end contiguous to the central portion of said impeller plate and the inner radial edge of said vane of said blades.

5. The invention set forth in claim 1 further including a stator surrounding said impeller, said stator including a mounting plate having a central aperture and upstanding spaced stator bars extending above said impeller plate and wherein bottom edges of each of said second blade extend below said stator plate aperture.

6. The invention as set forth in claim 1 further comprising a fixed stator surrounding and spaced from said series of blades, said stator including spaced vertical cross bars forming radial passageways therebetween, said bars having a horizontal radial cross-section such that the spaced passageways have parallel sides.

7. The invention set forth in claim 6 in which the centerlines of adjoining radial passageways are spaced from each other 12° to 18° and each passageway subtends an arc of from 8° to 12° at its inner entrance.

8. The invention set forth in claim 1 in which each of said blades extend radially from said central impeller portion to the outer periphery of said impeller plate and respective ones of said first vane and second blade are interconnected on a radial line from said central impeller portion.

9. The invention set forth in claim 8 in which adjoining radial blades are radially spaced from each other 36° to 45°.

10. A rotatable impeller for a flotation machine, said impeller comprising:

a flat plate having a central aperture for receiving an air supply;

a series of radially extending and vertically depending blades affixed to bottom portions of said plate; and wherein said blades include a first radially-inward vane for inducing air from said central aperture to an interblade region and a second radially-outward blade extending to a position adjacent the outer periphery of said flat plate for pumping and distributing aerated pulp in a flotation machine, said first vane being flat and having a bottom edge portion tapered downwardly from said impeller central position to an intersection attachment with said second blade, and said first vane further having a radial length less than the radial length of said second blade and a depending maximum height less than 50% of the height of said second blade.

11. The invention of claim 10 wherein said second blade is rectangular in vertical radial section and has an L/H ratio of from 0.8 to 1.4 where L is the radial length of the second blade and H is the vertical height of the second blade.

12. The invention of claim 10 in which each of said blades extend radially from said central impeller portion to the outer periphery of said impeller plate and said first vane and second blade are interconnected on a radial line from said central impeller portion.

13. The invention of claim 10 in which adjoining radial blades are radially spaced from each other 36° to 45°.

14. A froth flotation machine comprising:

a tank including vertical side walls to maintain a level of flotation pulp therein;

a motor-driven rotatable shaft extending into said tank;

an impeller attached to a bottom portion of said shaft; and means for delivering air to said impeller adjacent a central portion of said impeller;

said impeller comprising a disc extending radially from said central portion, and a series of radially extending, vertically depending blades affixed to said disc, said blades each including a first radially-inward vane extending from said central portion for inducing air from said air-delivery means to an interblade region and a second radially-outward blade extending from a position adjacent the outer periphery of said air-inducing vane to a position adjacent to the outer periphery of said disc for pumping and distribution of aerated pulp to a position radially exterior of said blades toward said tank side walls, said first vane at its point of intersection with the second blade being significantly shorter than the second blade.

15. A machine as set forth in claim 14 wherein the first vane tapers in height from its shortest section at the central portion of the disc to its greatest height at its point of intersection with the second blade.

16. A machine as set forth in claim 14 wherein the first vane at its point of intersection with the second blade is less than approximately 50% of the height of the second blade.

17. A rotatable impeller for a flotation machine, said impeller comprising:

a disc having a central aperture for receiving an air supply;

a series of radially extending and vertically depending blades affixed to bottom portions of said disc; and wherein said blades include a first radially-inward vane for inducing air from said central aperture to an interblade region and a second radially-outward blade extending to a position adjacent the outer periphery of said disc for pumping and distributing aerated pulp in a flotation machine, said first vane at its point of intersectin with the second blade being significantly shorter than the second blade.

18. An impeller as set forth in claim 17 wherein the first vane tapers in height from its shortest section at the central portion of the disc to its greatest height at its point of intersection with the second blade.

19. An impeller as set forth in claim 17 wherein the first vane at its point of intersection with the second blade is less than approximately 50% of the height of the second blade.

20. A machine as set forth in claim 19 wherein the second blade at its radial inner end is of a thickness comparable to that of first vane for providing a smooth transition therebetween.

21. An impeller as set forth in claim 20 wherein the second blade at its radial inner end is of a thickness comparable to that of first vane for providing a smooth transition therebetween.

22. A froth flotation machine comprising:

a tank including vertical side walls to maintain a level of flotation pulp therein;

a motor-driven rotatable shaft extending into said tank;

an impeller attached to a bottom portion of said shaft; and means for delivering air to said impeller adjacent a central portion of said impeller;

said impeller comprising a disc extending radially from said central portion, and a series of radially extending, vertically depending blades affixed to said disc, said blades including a first radially-inward vane extending from said central portion for inducing air from said air-delivery means to an interblade region and a second radially-outward blade extending from a position adjacent the outer periphery of said air-inducing vane to a position adjacent to the outer periphery of said disc for pumping and distribution of aerated pulp to a position radially exterior of said blades toward said tank side walls, said first vane being a rigid, relatively thin, generally planar member secured to the disc along a radius thereof, and said second blade being of generally bulbous configuration in horizontal section and having a width at its point of maximum width significantly greater than the width of the first vane.

23. A rotatable impeller for a flotation machine, said impeller comprising:

a disc having a central aperture for receiving an air supply;

a series of radially extending and vertically depending blades affixed to bottom portions of said disc; and wherein said blades include a first radially-inward vane for inducing air from said central aperture to an interblade region and a second radially-outward blade extending to a position adjacent the outer periphery of said disc for pumping and distributing aerated pulp in a flotation machine, said first vane being a relatively thin, generally planar member secured to the disc along a radius thereof and said second blade being of generally bulbous configuration in horizontal section and having a width at its point of maximum width significantly greater than the width of the first vane.

* * * * *